United States Patent [19]

Martin

[11] 4,068,752

[45] Jan. 17, 1978

[54] INTERACTING COIN-BLOCKOUT UNITS FOR A PREFERRED LOADING OF COIN TUBES

[75] Inventor: Bart G. Martin, St. Louis, Mo.

[73] Assignee: Coin Acceptors, Inc., St. Louis, Mo.

[21] Appl. No.: 718,779

[22] Filed: Aug. 30, 1976

[51] Int. Cl.[2] ..... G07F 1/00

[52] U.S. Cl. ..... 194/1 H

[58] Field of Search ..... 194/1 H, 1 C, 1 K, DIG. 14, 194/1, 2, 10

[56] References Cited

U.S. PATENT DOCUMENTS 3,741,362 6/1973 Shah ..... 194/1 H

*Primary Examiner*—Allen N. Knowles

*Attorney, Agent, or Firm*—Cohn, Powell & Hind

[57] ABSTRACT

A coin-feeding assembly for equally loading a particular denomination coin into a pair of coin tubes which includes a pair of coin-control units pivotally mounted generally above a pair of reception paths. One of the coin-control units has a coin-blockout deflector movable into and out of a position in an inlet path in which the deflector blocks entry of a coin to one of the reception paths and directs the coin to the other of the reception paths, and has a finger in the said one reception path that is responsive to the entrance of a coin into the said one reception path when the deflector of the said one unit is out of its blocking position for swinging the deflector into such position. The other coin-control unit has a first finger movable into and out of a position in which the first finger retains the coin introduced into the said one reception path, and has a second finger in the said other reception path and responsive to the impact of a coin deflected by said one unit into said other reception path for pivoting the said other unit and moving the said first finger out of its coin-retaining position whereby to release the retained coin. Both coins then move along their respective reception paths for storage.

8 Claims, 10 Drawing Figures

INTERACTING COIN-BLOCKOUT UNITS FOR A PREFERRED LOADING OF COIN TUBES

BACKGROUND OF THE INVENTION

This invention relates generally to a coin-feeding assembly, and more particularly to an improved assembly for automatically feeding coins equally into a pair of coin tubes from which coins are obtained for returning change to customers.

It is common for customers to deposit coins of larger denomination than required for the purchase of an article from a vending machine, and to receive appropriate change paid back by the machine in coins in smaller denomination. For example, articles selling for 15 cents are often purchased by the deposit of a quarter which requires the coin changer apparatus of the vending machine to pay back a dime in change. The coin changer apparatus must, therefore, continuously maintain an adequate supply of dimes, gathered from dimes that are deposited by customers in the machine. It has been found desirable to provide the coin changer with a pair of dime storage tubes from which change may alternately be paid out. It is also desirable that the number of dimes being stored in the pair of storage tubes be maintained as nearly equal as possible.

Heretofore, to equally load a particular denomination coin into a pair of coin tubes, a separate coin passageway was provided to each coin tube and a mechanical flipper was located in the acceptor mechanism which alternately directed the incoming coins down these separate passageways. The practicality of a mechanical flipper is limited by the size and weight of the coins. For example, it is more difficult to design a mechanical flipper for a dime than it is for a nickel. Also, some foreign coins are smaller and weigh less than a dime, thereby further increasing the degree of difficulty in designing a reliable flipper.

Usually in an acceptor, the coin tube blockout units, located at the entrance of each coin tube, provide only overfill protection, i.e., after the coin tubes are fully loaded with coins, all additional incoming coins are diverted by the coin-blockout units into the cash box. In U.S. Pat. No. 3,741,362, a separate latch mechanism was provided between a pair of coin-blockout units which enabled such units to alternately feed coins into a pair of coin tubes. However, this separate latch mechanism required precise location and adjustment to maintain effective operation.

SUMMARY OF THE INVENTION

The present coin-feeding assembly eliminates the need for a mechanical flipper. Moreover, while the present invention utilizes coin-blockout units for a preferred loading of the coin tubes, the requirement for a separate interconnecting latch mechanism is avoided.

In the present coin-feeding assembly, a pair of coin-control units are pivotally mounted generally above the reception paths or coin tubes. One of the coin control units includes a coin-blockout deflector that is movable into and out of a position in an inlet path in which the deflector blocks entry of a coin to one of the reception paths and directs the coin to the other of the reception paths, and includes a finger in the said one reception path which is responsive to the entrance of a coin in said one reception path when the deflector of the said one unit is out of its blocking position for swinging the deflector into the blocking position. The other coin-control unit includes a first finger movable into and out of a position in which the first finger retains the coin introduced into the said one reception path, and includes a second finger in the said other reception path which is responsive to the impact of another coin deflected by the said one unit into the said other reception path for pivoting the said other unit and moving the said first finger out of its coin-retaining position, whereby to release the retained coin. Both coins then move along their respective reception paths for storage.

Each coin-control unit includes a weight, the weight of the said one unit biasing the deflector out of its blocking position and the weight of the said other unit biasing the first finger into its coin-retaning position.

In the present coin-feeding assembly, the first finger of the said other coin-control unit includes a portion that underlies and engages the coin introduced into the said one reception path when the first finger is disposed in its coin-retaining position. More particularly, this first finger portion extends across and is angularly related to the retained coin seated on the first finger portion so that the coin weight tends to maintain the first finger in its coin-retaining position.

The finger of the said one coin-control unit is disposed relative to the first finger of the said other coin-control unit so that it is engaged by the coin retained by the first finger so as to pivot the said one unit and move the associated deflector to its blocking position.

DESCRIPTION OF THE PREFERRED EMBODIMENT

Figure 1:
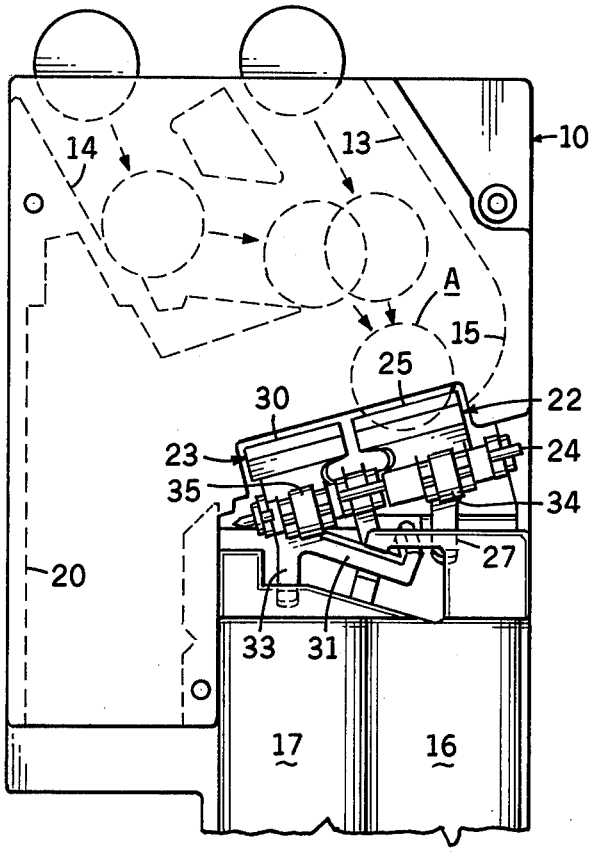
FIG. 1 is a fragmentary, side elevational view of a coin track assembly of a typical coin changer apparatus provided with the coin-feeding assembly.

Referring now by characters of reference to the drawings, it will be understood that the coin track assembly 10 includes a pair of cooperating, mating chute sections 11 and 12 which normally face each other and define various passages and compartments for the gravitational movement and storage of coins. More particularly, the chute sections 11–12 provide a pair of passages 13 and 14 leading to a common inlet path 15. The common inlet path 15 is in communication with a pair of adjacent coin storage tubes 16 and 17 constituting reception paths. In addition, the inlet path 15 is in communication with an auxiliary channel 20 leading to a coin collection box 21 best shown in FIG. 10. The common inlet path 15 directs all gravitating coins initially toward the tube 16, the trajectory being such that coins will fall toward and enter the tube 16 unless the tube 16 is blocked. The coins will normally reach the other tube 17 or the auxiliary channel 20 only when diverted by the coin-feeding assembly as will be apparent upon later detailed description of parts.

It will be understood that the track assembly 10 may be associated with or form a part of any conventional coin-changing apparatus and will normally be disposed below a conventional coin-accepting and rejecting unit which is capable of testing coins inserted by a customer for genuineness and separating them into various denominations so that only those coins of the particular denomination to be stored in the tubes 16 and 17 will be dropped into the passages 13–14 and move into the inlet path 15. Because the other portions of the coin-changing apparatus and the structure of the coin-accepting and rejecting unit form no part of the present invention, and because their nature is well known to those skilled in the art, they have not been illustrated in the drawings and need not be further described.

The coin-feeding assembly includes a pair of generally C-shaped coin-control units 22 and 23 disposed respectively adjacent the tops of the coin tubes 16 and 17 and within the inlet path 15. The coin-control units 22 and 23 are pivotally supported by a common inclined shaft 24 in side-by-side relationship, the shaft 24 being carried on the chute section 12 in any suitable manner. The pivotal rocking movement of the coin-control units 22 and 23 are limited by the interferences that occur with the chute section 12 at the extremes of arc movements.

The coin-control unit 22 includes a coin-blockout deflector 25 on the upper leg 26, and includes a finger 27 as the lower leg. The deflector 25 is movable into and out of a position in the inlet path 15 in which the deflector 25 blocks entry of a coin to the tube 16 and directs the coin to the other tube 17. The finger 27 is located in the tube 16 so as to be responsive to the entrance of a coin into the tube 16 when the deflector 25 of the unit 22 is out of its blocking position for swinging the deflector 25 into the blocking position.

The other coin-control unit 23 includes a coin-blockout deflector 30 movable into and out of a position in the inlet path 15 in which the deflector 30 blocks entry of another coin to the coin tube 17, and directs such coin to the auxiliary channel 20.

The coin-control unit 23 also includes a lower first finger 31 that extends into the coin tube 16, the first finger 31 is movable into and out of a position in which the first finger 31 retains the coin introduced into the coin tube 16. More particularly, the first finger 31 has a portion 32 that underlies and engages the coin introduced into the coin tube 16 when the finger 31 is in its coin-retaining position. This first finger portion 32 extends across and is angularly related to the retained coin so that the coin weight tends to maintain the first finger 31 in its coin-retaining position.

Further, the coin-control unit 23 has a second finger 33 at its lower end that is located in the coin tube 17 and is responsive to the impact of another coin deflected by the unit 22 into the coin tube 17, the second finger 33 pivoting the coin-control unit 23 and moving the first finger 31 out of its coin-retaining position whereby to release the retained coin. Both coins then drop substantially simultaneously into their respective coin tubes 16 and 17.

The finger 27 of the coin-control unit 22 is disposed adjacent to the first finger 31 of the other coin-control unit 23, and especially is disposed closely adjacent the first finger portion 32 so that the finger 27 is engaged by the retained coin to swing the deflector 25 to its blocking position and to maintain the deflector 25 in its blocking position while the coin is retained.

The coin-control units 22 and 23 have weights 34 and 35, constituting biasing means, disposed to the outside of the shaft 24 to yieldably bias the deflectors 25 and 30 out of their blocking position, and to yieldably bias the finger 27 and 33 respectively into the coin tubes 16 and 17. The weight 35 associated with the coin-control unit 23 further yieldably biases the first finger 31 into its coin-retaining position.

Figure 2:
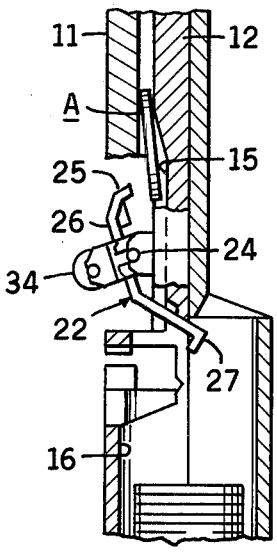
FIG. 2 is a fragmentary cross-sectional view longitudinally of the right hand coin tube shown in FIG. 1 and illustrating the position of the associated overlying coin-control unit to permit passage of a coin.
Figure 4:
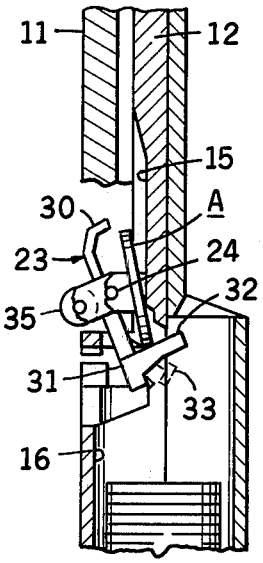
FIG. 4 is a fragmentary cross-sectional view similar to FIG. 2, but illustrating the position of the other coin-control unit in its coin-retaining position.

The sequence of events in the coin-feeding cycle may most easily be understood by initially considering the coin-feeding assembly when it is disposed in the condition illustrated in FIGS. 1, 2 and 4. At this time, the deflectors 25 and 30 of the coin-control units 22 and 23 are disposed out of their coin-blocking positions, and the fingers 27 and 33 are disposed in the coin tubes 16 and 17 respectively, while the finger 31 is disposed in its coin-retaining position in the coin tube 16.

Figure 3:
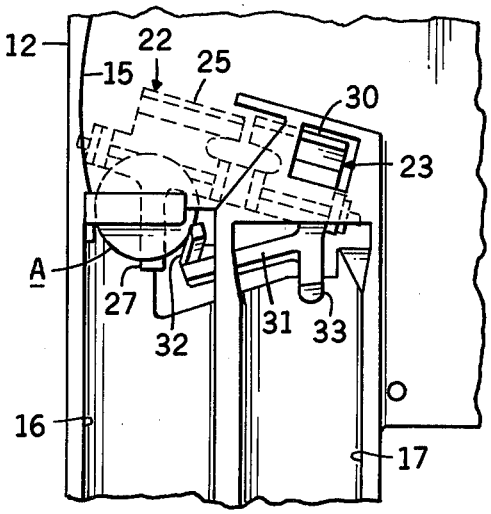
FIG. 3 is a fragmentary elevational view from the side opposite to that illustrated in FIG. 1, showing the coin retained.

As the first coin A, such as a dime, passes through and along the inlet path 15, it will move past the deflector 25 and into the top of tube 16 as is best shown in FIGS. 1 and 2. The coin A will engage and seat on the first finger position 32 of the first finger 31 that is disposed in the coin-retaining position. Consequently, the coin A is retained. Simulataneously, the coin A engages the finger 27 in thetube 16, and swings the deflector 25 of the coin-control unit 22 to its blocking position as shown in FIGS. 3, 5 and 6.

Figure 5:
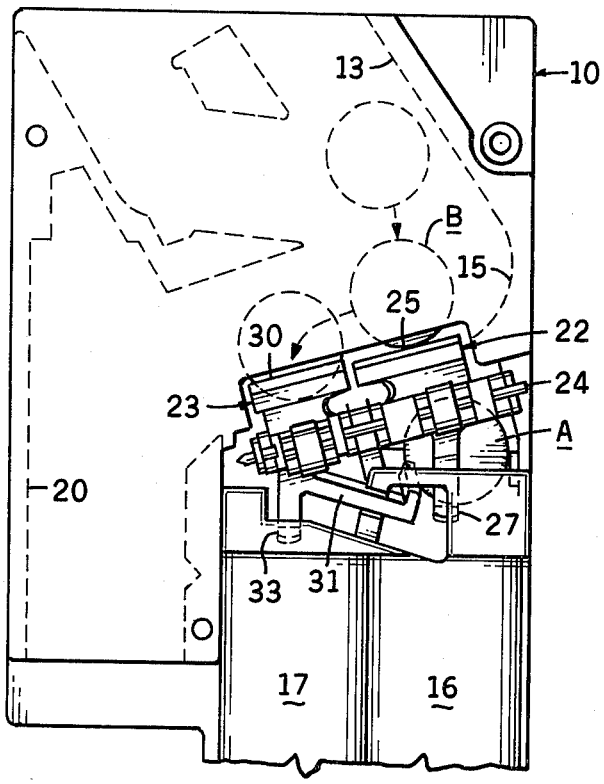
FIG. 5 is a fragmentary side elevational view similar to FIG. 1, but showing the deflection of another coin to the left hand storage tube.
Figure 6:
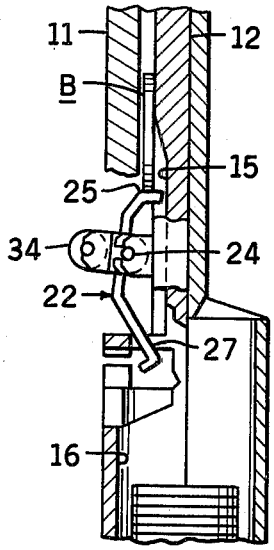
FIG. 6 is a fragmentary cross-sectional view similar to FIG. 2, but illustrating the associated one coin-control unit in its blocking position and deflecting the said other coin.
Figure 7:
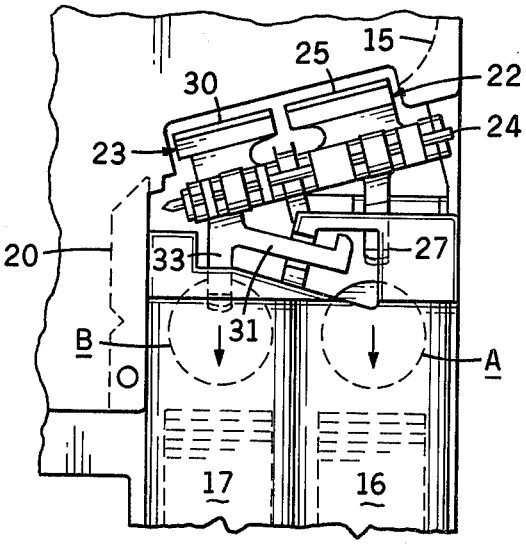
FIG. 7 is a fragmentary side elevational view similar to FIG. 5, but showing both coins dropping into the coin storage tubes.
Figure 8:
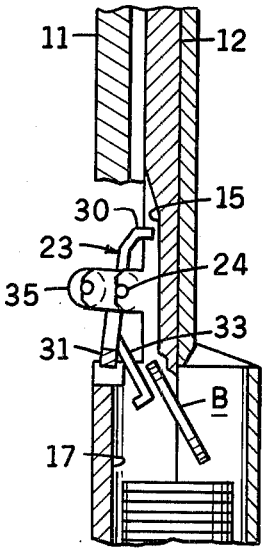
FIG. 8 is a fragmentary cross-sectional view longitudinally of the left hand storage tube of FIG. 7 illustrating the position of the associated overlying other coin-control unit when moved out of its coin-retaining position.
Figure 9:
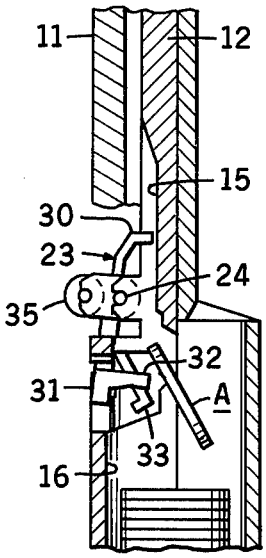
FIG. 9 is a fragmentary cross-sectional view similar to FIG. 4, but illustrating the position of the said other coin-control unit when moved out of its coin-retaining position.

When the next succeeding coin B enters the inlet path 15, it will engage the deflector 25 and be directed toward the unobstructed coin tube 17 as illustrated in FIG. 5. As the coin B moves past the deflector 30 of the coin-control unit 23 and into the top of coin tube 17, the coin B engages the finger 33 to swing the unit 23 and move the finger 31 out of its coin-retaining position, as shown in FIGS. 8 and 9. The coin A is released from the first finger portion 32, and both coins A and B fall substantially simultaneously into their respective tubes 16 and 17. The coin-control units 22 and 23 then assume their original positions and are ready to repeat the feed cycle as additional coins are subsequently deposited.

Figure 10:
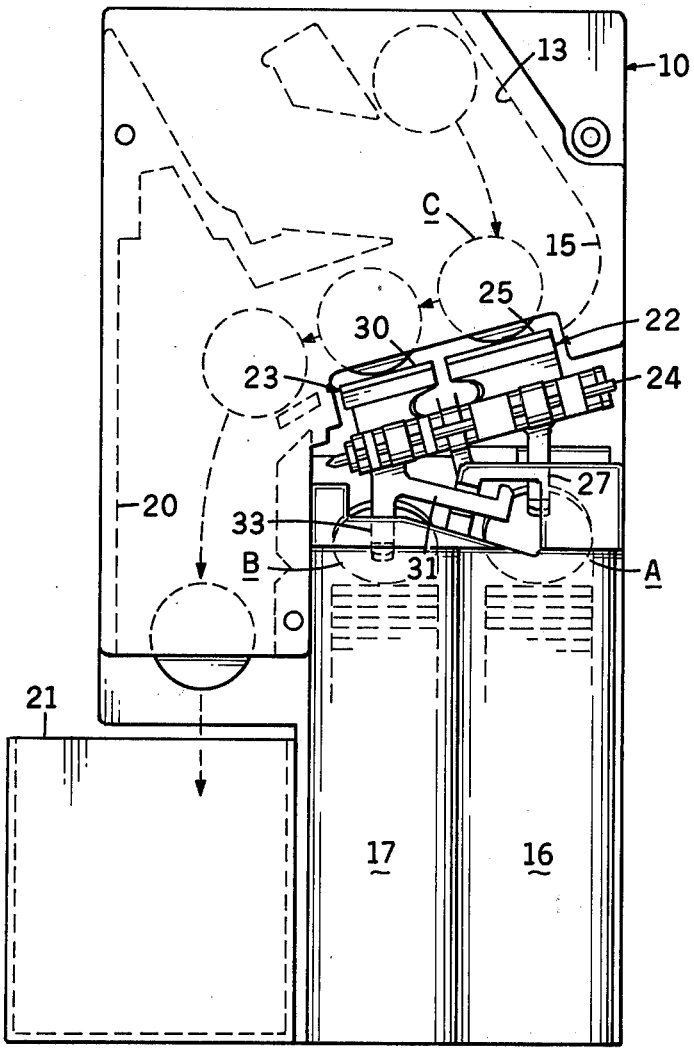
FIG. 10 is an elevational view similar to FIG. 1, but illustrating the assembly in condition for diverting coins away from both of the primary storage tubes and into an auxiliary channel and cash box when the primary storage tubes are both filled with stored coins.

The above described feed cycle is then repeated until such time as the tubes 16 and 17 become completely filled as shown in FIG. 10. At this time, it will be seen that the top coin A and B in each of the tubes 16 and 17 respectively engages the finger 27 or 33, and maintains the deflector 25 or 30 of the associated coin-control unit 22 or 23, in its respective blocking position. Then, when the next coin C enters the inlet path 15, it will be first deflected by deflector 25 of unit 22 onto deflector 30 of unit 23, which in turn directs the coin C into the channel 20 for storage in the coin collection box 21. Once enough change coins have been dispensed from the lower end of tubes 16 and 17 to release the fingers 27 and 33, the coin-feed mechanism is once again able to feed coins into the tubes 16 and 17 by the feed cycle described previously.

I claim as my invention:

1. In a coin-feeding assembly:

a. means providing a common inlet path through which a coin can move edgewise, and a pair of reception paths generally below the inlet path, b. a pair of coin-control units pivotally mounted generally above the reception paths for individual swinging movement of the units, c. one coin-control unit including:

1. a coin-blockout deflector movable into and out of a position in the inlet path in which the deflector blocks entry of a coin to one of the reception paths and directs the coin to the other of the reception paths, and 2. a finger in said one reception path and responsive to the entrance of a coin into said one reception path when the deflector of said one unit is out of its blocking position for swinging the deflector into said position, and d. the other of the coin-control units including:

1. a first finger movable into and out of a position in which the first finger retains the coin introduced into the said reception path, and 2. a second finger in the said other reception path and responsive to the impact of a coin deflected by said one unit into the said other reception path for pivoting the said other unit and moving the said first finger out of its coin-retaining position to release the retained coin.

2. In the coin-feeding assembly as defined in claim 1, in which:

e. means bias the deflector of said one unit out of its blocking position but is incapable of counteracting the force of a coin impacting the finger of said one unit, and f. means bias the first finger of said other unit into its coin-retaining position but is incapable of counteracting the force of a coin impacting the second finger of said unit.

3. In a coin-feeding assembly as defined in claim 1, in which:

e. the first finger of said other unit includes a portion underlying and engaging the coin introduced into the said one reception path when in its coin-retaining position.

4. In a coin-feeding assembly as defined in claim 3, in which:

f. the said first finger portion of said other unit extends across and is angularly related to the retained coin so that the coin weight tends to maintain the said first finger in its coin-retaining position.

5. In a coin-feeding assembly as defined in claim 3, in which:

f. the finger of said one unit is engaged by the retained coin to pivot the said one unit and move the deflector to its blocking position.

6. In a coin-feeding assembly as defined in claim 1, in which:

e. the finger of said one unit is engaged by the coin retained by the first finger of the said other unit to pivot the said one unit and move the deflector to its blocking position while the coin is retained.

7. In a coin-feeding assembly as defined in claim 1, in which:

e. the said first finger of said other unit includes a portion extending into the said one reception path in its coin-retaining position to engage and retain the coin introduced into the said one reception path, and f. the finger of the said one unit is engaged by the coin retained by the first finger portion of the said other unit to swing the deflector to and to maintain the deflector in its blocking position while the coin is retained.

8. In a coin-feeding assembly as defined in claim 1, in which:

e. means bias the deflector of said one unit out of its blocking position, f. means bias the first finger of said other unit into its coin-retaining position, g. the said first finger of said other unit includes a portion extending into the said one reception path in its coin-retaining position to engage and retain the coin introduced into the said one reception path, and h. the finger of said one unit is engaged by the coin retained by said first finger portion of said other unit to swing the deflector to and to maintain the deflector in its blocking position while the coin is retained.

* * * * *